US011350504B2

(12) United States Patent
Zheng et al.

(10) Patent No.: US 11,350,504 B2
(45) Date of Patent: May 31, 2022

(54) LED DRIVE CIRCUIT AND METHOD THEREOF

(71) Applicant: Silergy Semiconductor Technology (Hangzhou) LTD, Hangzhou (CN)

(72) Inventors: Qingliang Zheng, Hangzhou (CN); Qiukai Huang, Hangzhou (CN); Jianxin Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 17/068,046

(22) Filed: Oct. 12, 2020

(65) Prior Publication Data

US 2021/0029799 A1 Jan. 28, 2021

Related U.S. Application Data

(63) Continuation of application No. 16/410,008, filed on May 13, 2019, now Pat. No. 10,880,967.

(30) Foreign Application Priority Data

May 29, 2018 (CN) ..... 201810534398.5

(51) Int. Cl.

| | |
|---|---|
| ***H05B 45/50*** | (2022.01) |
| ***H05B 45/37*** | (2020.01) |
| ***H05B 45/30*** | (2020.01) |
| ***H05B 45/355*** | (2020.01) |
| ***H05B 45/36*** | (2020.01) |
| ***H05B 45/395*** | (2020.01) |

(52) U.S. Cl.

CPC ..... *H05B 45/50* (2020.01); *H05B 45/30* (2020.01); *H05B 45/37* (2020.01); *H05B 45/355* (2020.01); *H05B 45/36* (2020.01); *H05B 45/395* (2020.01)

(58) Field of Classification Search

CPC ..... H05B 37/0272; H05B 37/0227; H05B 37/0281; H05B 33/0854; H05B 33/0872; H05B 33/0803; H05B 37/0218; H05B 33/0815; H05B 33/0842; H05B 33/0845; H05B 33/0857; H05B 33/0809; H05B 33/0884; H05B 37/0245; H05B 37/0263; H05B 33/08; H05B 33/086; H05B 33/0869; H05B 33/0887; H05B 33/089; H05B 1/0244; H05B 2203/021; H05B 2203/022; H05B 33/0827; H05B 33/0851; H05B 3/0014; H05B 3/04; H05B 3/44; H05B 33/0812; H05B 33/0824; H05B 37/02

See application file for complete search history.

(56) References Cited

U.S. PATENT DOCUMENTS

| | | | | |
|---|---|---|---|---|
| 8,581,518 | B2 * | 11/2013 | Kuang | H05B 45/10 315/307 |
| 2011/0127925 | A1 | 6/2011 | Huang et al. | |
| 2017/0318639 | A1 | 11/2017 | Wang et al. | |
| 2018/0295685 | A1 | 10/2018 | Wang et al. | |
| 2018/0295690 | A1 * | 10/2018 | Chen | H05B 47/10 |
| 2018/0310376 | A1 * | 10/2018 | Huang | H05B 45/10 |

* cited by examiner

*Primary Examiner* — Monica C King

(57) ABSTRACT

An LED drive circuit can include: a transistor and an LED load coupled in series, and being configured to receive a direct current bus voltage, and to generate an input current; and a control circuit configured to generate a drive signal to control an operation state of the transistor to control a distribution range of the input current by controlling an amount of accumulated charge of the input current during a half power frequency period.

19 Claims, 13 Drawing Sheets

LED DRIVE CIRCUIT AND METHOD THEREOF

RELATED APPLICATIONS

This application is a continuation of the following application, U.S. patent application Ser. No. 16/410,008, filed on May 13, 2019, and which is hereby incorporated by reference as if it is set forth in full in this specification, and which also claims the benefit of Chinese Patent Application No. 201810534398.5, filed on May 29, 2018, which is incorporated herein by reference in its entirety.

FIELD OF THE INVENTION

The present invention generally relates to the field of power electronics, and more particularly to LED drivers and associated control methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
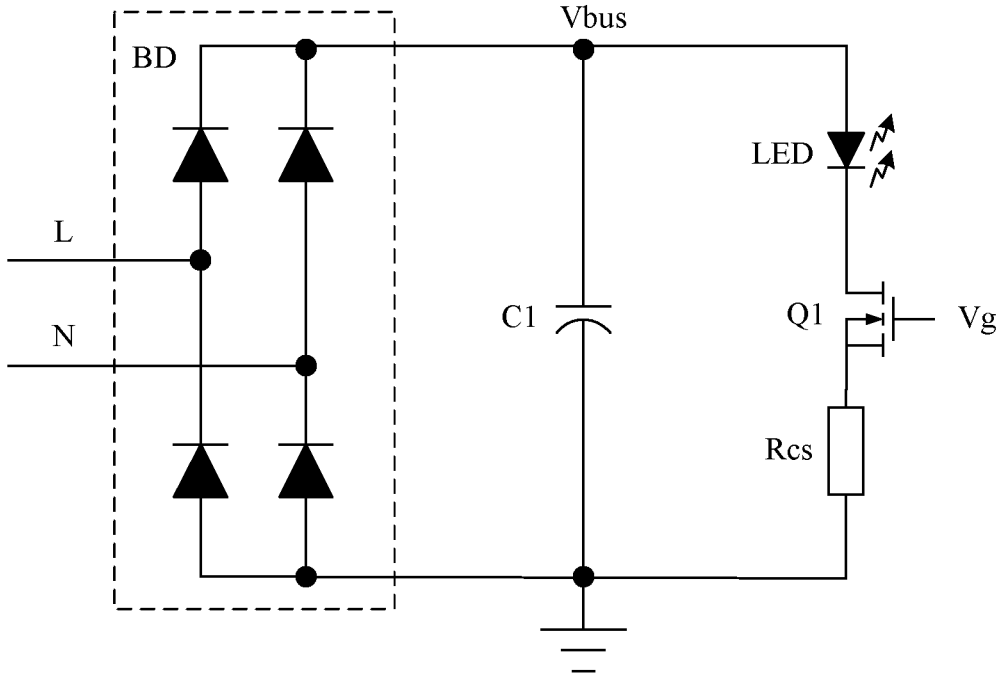
FIG. 1 is a schematic block diagram of an example LED drive circuit.
Figure 2:
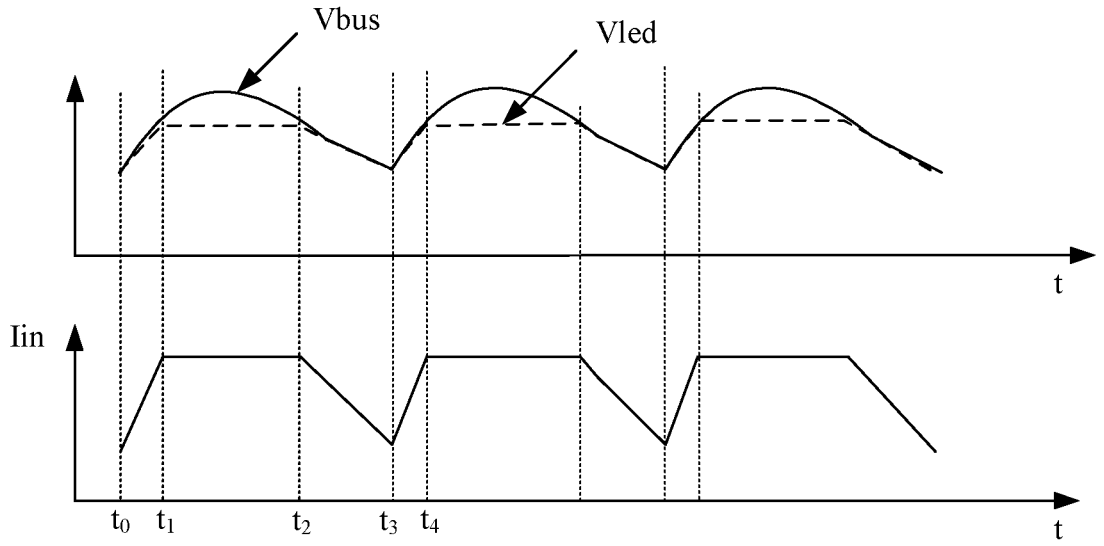
FIG. 2 is a waveform diagram of example operation of the LED drive circuit shown in FIG. 1.

Light-emitting diodes (LEDs) are widely used as light sources due to advantages of having high luminous efficiency, long life, and low power consumption. The LED load, as a constant current load, may be driven by a driver that can output a constant current. In FIG. 1, shown is a schematic block diagram of an example LED drive circuit, and FIG. 2 shows a waveform diagram of example operation of the LED drive circuit of FIG. 1. This example LED drive circuit can include sampling resistor Rcs and transistor Q1 connected in series with an LED load. When the LED drive circuit is powered by an LED power source, the LED drive circuit can connect to an output end of rectification bridge BD, in order to obtain direct current bus voltage Vbus. Capacitor C1 can connect to the output ends of the rectification bridge BD. During operation, transistor Q1 in the LED drive circuit may operate in a linear mode/region. The operation state of transistor Q1 can be controlled based on a feedback signal for an input current flowing through the transistor, in order to obtain a substantially constant input current.

In the linear drive manner, a relatively small number of devices are required, and the control is relatively simple. However, the voltage output by the rectification bridge may periodically fluctuate due to being a sinusoidal half-wave signal of a half power frequency period, which may result in periodical fluctuation of direct current bus voltage Vbus. In FIG. 2, when direct current bus voltage Vbus is higher than load voltage Vled, the LED drive circuit can output a set/predetermined current. When direct current bus voltage Vbus approximates load voltage Vled, the current may be decreased as shown.

However, when the average of direct current bus voltage Vbus is much higher than load voltage Vled, the capacitance of capacitor C1 may need to be increased in order to obtain constant current. This can result in increased loss of transistor Q1, and decreased overall system efficiency. Further, the power factor (PF) may be decreased due to the relatively large capacitance of capacitor C1. When the instantaneous value of direct current bus voltage Vbus approximates that of load voltage Vled, the input current may be decreased and the adjustment rate degraded. In this case, the current can approximately be in an open-loop state. If there is signal interference or grid jitter, the operation state of transistor Q1 may not be controlled in time to adjust the input current, which can result in light flickering.

Figure 3:
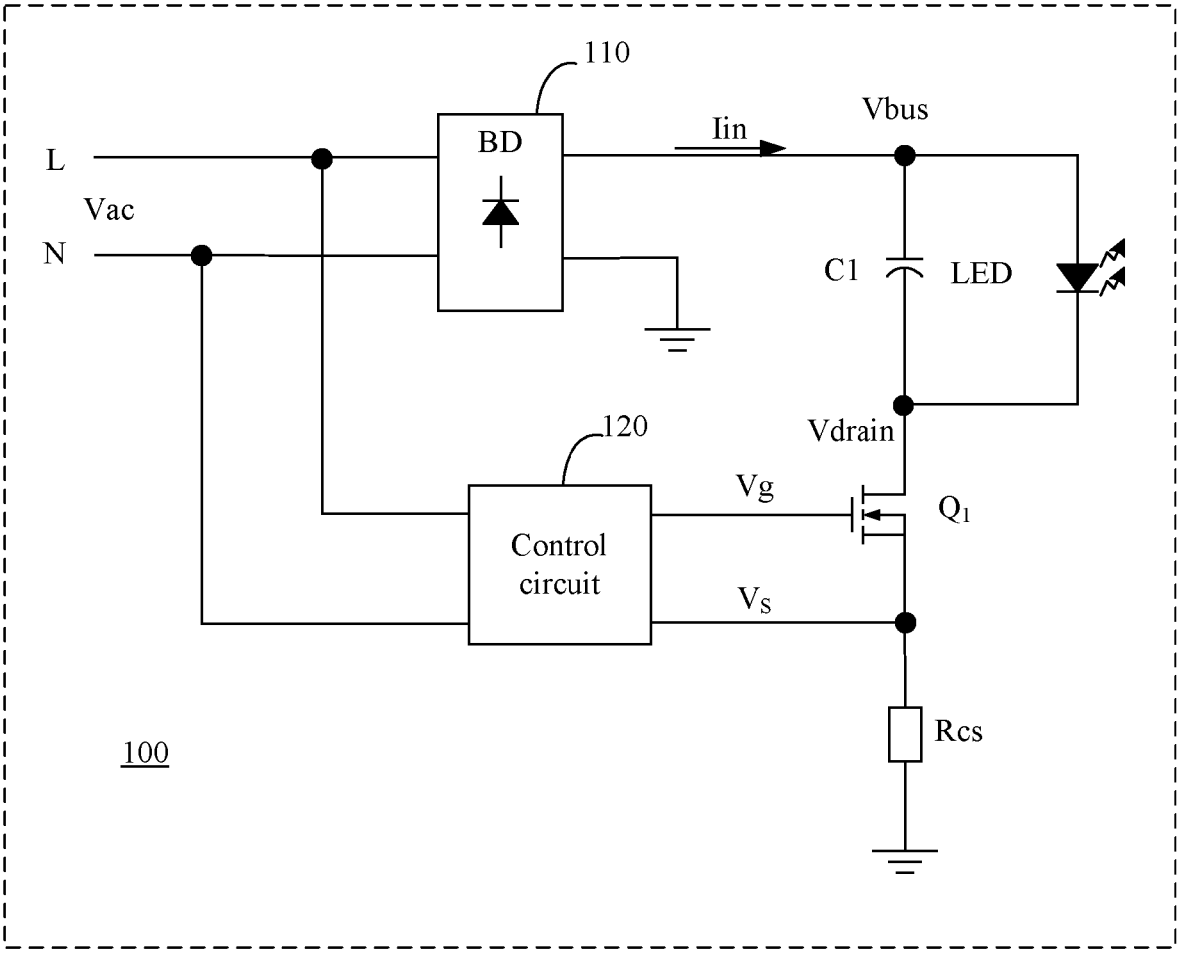
FIG. 3 is a schematic block diagram of a first example LED drive circuit, in accordance with embodiments of the present invention.

Referring now to FIG. 3, shown is a schematic block diagram of a first example LED drive circuit, in accordance with embodiments of the present invention. In this particular example, LED drive circuit 100 can include a main circuit and control circuit 120. The main circuit can include rectification bridge 110, an LED load, transistor Q1, capacitor C1, and sampling resistor Rcs. The LED load, transistor Q1, and sampling resistor Rcs can connect in series between two output ends of rectification bridge 110. Rectification bridge 110 can rectify alternating current input voltage Vac to acquire direct current bus voltage Vbus, and supply input current Iin to capacitor C1 and the LED load. Capacitor C1 can connect in parallel to the LED load, in order to smooth voltage Vled of the load. Input current Iin flowing through capacitor C1 and the LED load may flow to a ground end via transistor Q1. Sampling resistor Rcs can obtain current sampling signal Vs of a current flowing through transistor Q1.

For example, transistor Q1 may be implemented by a metal-oxide-semiconductor field-effect transistor (MOSFET). Those skilled in the art will recognize that transistor Q1 may additionally or alternatively be implemented by other electronically controlled switches (e.g., a bipolar junction transistor [BJT], an insulated gate bipolar transistor [IGBT], a single MOSFET, a combination of multiple BJTs or MOSFETs, etc.). During operation, control circuit 120 in the LED drive circuit may generate drive signal Vg based on current sampling signal Vs, to control an operation state of transistor Q1, in order to control a load current flowing through the LED load. Since a value of the current flowing through transistor Q1 may be equal to a value of input current Iin, the amount of accumulated charge of input current Iin during a half power frequency period can be controlled by controlling the operation state of transistor Q1, such that a distribution range of input current Iin can be controlled. This can improve a power factor and system efficiency of the LED drive circuit, and substantially avoid light flickering due to signal interference and/or grid jitter.

For example, control circuit 120 can control the amount of accumulated charge of input current Iin during the half power frequency period to be constant according to application environments of LED drive circuit 100. Transistor Q1 can be controlled so that a value of input current Iin a first time period/duration (e.g., T1) of the half power frequency period is greater than a value of input current Iin a second time period/duration (e.g., T1) of the half power frequency period. For example, in time period T1, transistor Q1 can operate in a switching mode, and in time period T2, transistor Q1 may operate in a linear mode. Time period T1 may be before or after time period T2. For example, time period T1 can be in a rising phase of direct current bus voltage Vbus, and time period T2 after time period T1. Alternatively, time period T1 can be in a falling phase of direct current bus voltage Vbus, and time period T2 before time period T1. Control circuit 120 may perform the function of current integration control based on current sampling signal Vs of input current Iin in time period T1, to keep the amount of accumulated charge of input current Iin during time period T1 constant. Control circuit 120 may perform the function of timing control in time period T2, in order to keep the amount of accumulated charge of input current Iin during time period T2 constant.

Figure 4:
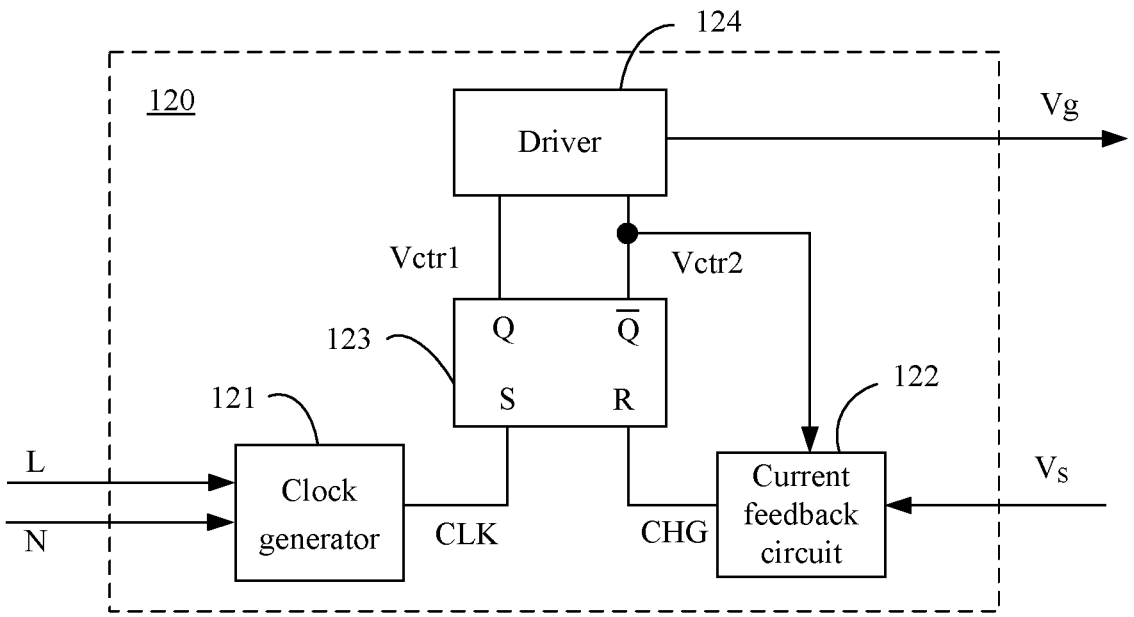
FIG. 4 is a schematic block diagram of an example control circuit of the first example LED drive circuit shown in FIG. 3, in accordance with embodiments of the present invention.

Referring now to FIG. 4, shown is a schematic block diagram of an example control circuit of the first example LED drive circuit shown in FIG. 3, in accordance with embodiments of the present invention. In this particular example, control circuit 120 can include clock generator 121, current feedback circuit 122, logic circuit 123, and driver 124. For example, clock generator 121 may acquire alternating current input voltage Vac from alternating current input ends of rectification bridge 110, and may generate clock signal CLK at a start time instant of the half power frequency period based on a sampling signal of alternating current input voltage Vac. Current feedback circuit 122 may acquire current sampling signal Vs from sampling resistor Rcs, and generate charge control signal CHG based on current sampling signal Vs and a current integration signal of current sampling signal Vs.

For example, logic circuit 123 may be an RS flip-flop. A set terminal and a reset terminal of the RS trigger can respectively connect to an output end of clock generator 121 and an output end of current feedback circuit 122. Logic circuit 123 may generate, based on clock signal CLK and charge control signal CHG, control signals Vctr1 and Vctr2, which are complementary to each other. Driver 124 can connect to output ends of logic circuit 123, and may generate drive signal Vg based on at least one of control signals Vctr1 and Vctr2. Further, current feedback circuit 122 can connect to the output end of logic circuit 123, and current feedback circuit 122 may reset the current integration signal based on control signal Vctr2.

Figure 5:
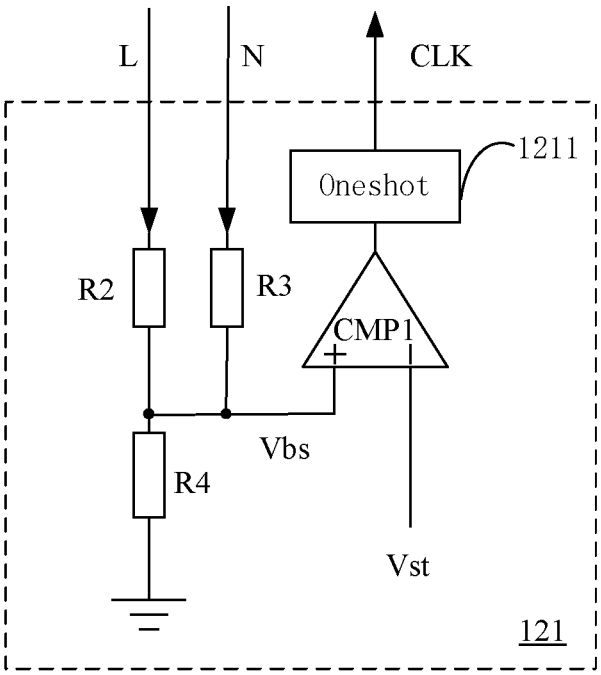
FIG. 5 is a schematic block diagram of an example clock generator of the example control circuit shown in FIG. 4, in accordance with embodiments of the present invention.

Referring now to FIG. 5, shown is a schematic block diagram of an example clock generator of the example control circuit shown in FIG. 4, in accordance with embodiments of the present invention. In this particular example, clock generator 121 can include a resistor divider network, comparator CMP1, and one-shot (pulse generator) circuit 1211. For example, the resistor divider network can include resistors R2 and R4 connected in series, and resistor R3 connected to a node between resistors R2 and R4. Resistor R4 may be grounded. Resistors R2 and R3 can respectively connect to two ends of alternating current input voltage Vac. Sampling signal Vbs of alternating current input voltage Vac may be obtained at the node between resistors R2 and R4. A non-inverting input terminal of comparator CMP1 can receive sampling signal Vbs of the alternating current input voltage, and an inverting input terminal of comparator CMP1 can receive reference voltage Vst. Comparator CMP1 can compare sampling signal Vbs of the alternating current input voltage against reference voltage Vst to generate a trigger signal. One-shot circuit 1211 can generate clock signal CLK in response to the trigger signal. For example, a pulse width of the trigger signal may be about 500 μs.

A period of clock signal CLK can be equal to the half power frequency period of direct current bus voltage Vbus. Clock signal CLK can trigger a single-pulse current in the rising phase of direct current bus voltage Vbus, such that time period T1 begins. For example, a trigger time instant of clock signal CLK in the half power frequency period can be controlled by setting a value of reference voltage Vst, and the pulse width of clock signal CLK may be controlled by setting a delay time period of one-shot circuit 1211. In this example, clock signal CLK may be generated based on voltage sampling signal Vbs indicating alternating current input voltage Vac. In other examples, voltage sampling signal Vbs may be obtained by sampling direct current bus voltage Vbus or voltage Vdrain across transistor Q1. For example, a diode can connect in series between the output end of rectification bridge 110 and an anode of the LED load, in order to prevent reverse flowing of the current.

Figure 6:
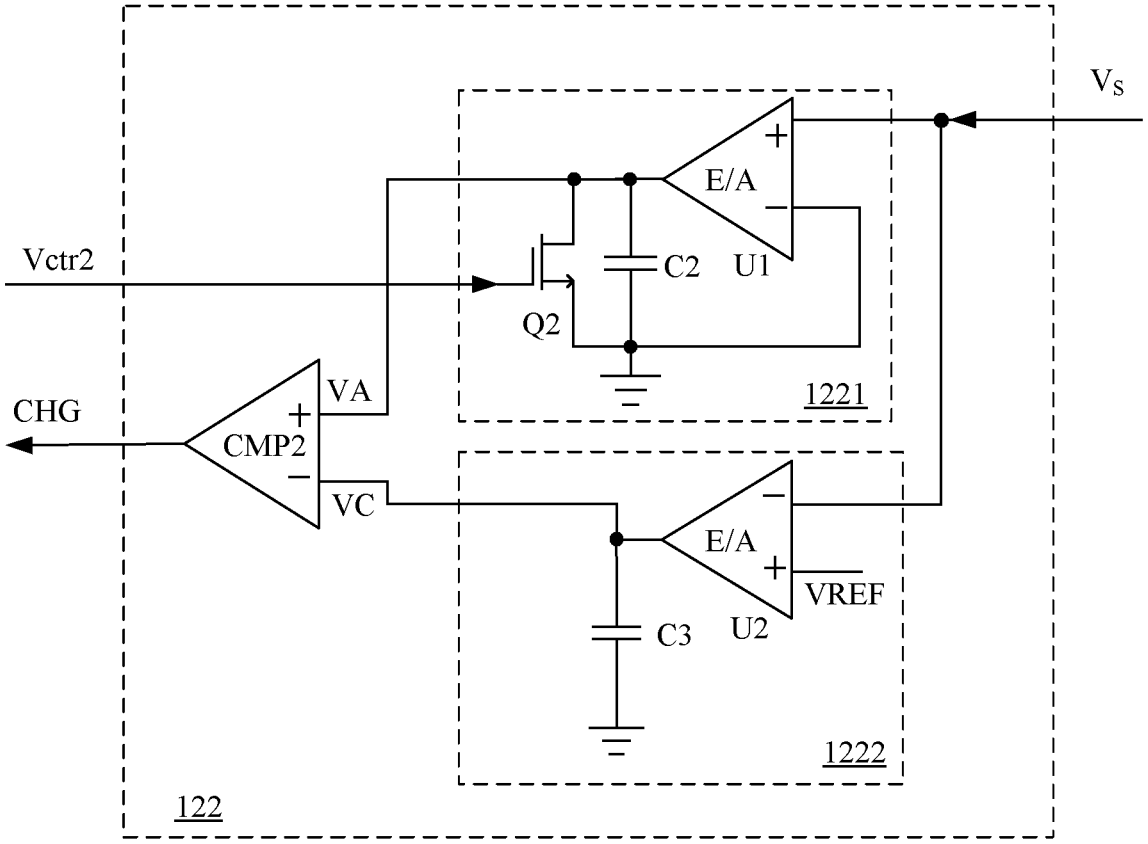
FIG. 6 is a schematic block diagram of an example current feedback circuit of the example control circuit shown in FIG. 4, in accordance with embodiments of the present invention.

Referring now to FIG. 6, shown is a schematic block diagram of an example current feedback circuit of the example control circuit shown in FIG. 4, in accordance with embodiments of the present invention. In this particular example, current feedback circuit 122 can include current integration circuit 1221, closed-loop feedback circuit 1222, and comparator CMP2. Current integration circuit 1221 can include error amplifier U1, capacitor C2, and transistor Q2. A non-inverting input terminal of error amplifier U1 can receive current sampling signal Vs of the current flowing through transistor Q1, and an inverting input terminal of error amplifier U1 may be grounded. Capacitor C2 and transistor Q2 can connect in parallel between an output terminal of error amplifier U1 and ground. Current integration signal VA may be generated between two terminals of capacitor C2.

Closed-loop feedback circuit 1222 can include error amplifier U2, and capacitor C3. A non-inverting input terminal of error amplifier U2 may be supplied with reference voltage VREF, and an inverting input terminal of error amplifier U2 can receive current sampling signal Vs of the current flowing through transistor Q1. Capacitor C3 can connect between an output terminal of error amplifier U2 and ground. Compensation signal VC may be generated between two terminals of capacitor C3. Reference voltage VREF can indicate desired current value IREF. The compensation signal generated by error amplifier U2 may indicate an error between an average of load current Iled and desired current value IREF. In this example, capacitor C3 can average an error signal output by error amplifier U2. Those skilled in the art will recognize that resistor(s), inductor(s) and/or other capacitor(s) may be added in the compensation circuit according to the parameter/type of the signal output by the error amplifier.

An inverting input terminal of comparator CMP2 can receive compensation signal VC, and a non-inverting input terminal of comparator CMP2 can receive current integration signal VA. Comparator CMP2 can compare compensation signal VC against current integration signal VA to generate charge control signal CHG. In time period T1, transistor Q1 in the main circuit may be turned on and operate in the switching mode. In this case, a single-pulse current may be generated. Current integration circuit 1221 can integrate the single-pulse current. When current integration signal VA is increased to be a value greater than or equal to that of compensation signal VC, charge control signal CHG generated by comparator CMP2 may transition from an inactive state to an active state.

Further, a control terminal of transistor Q2 in the control circuit can connect to logic circuit 123 (see, e.g., FIG. 4), such that the operation state of transistor Q2 may be related to control signal Vctr2 generated by logic circuit 123. In time period T1, transistor Q2 can be turned off. Also, an output of current integration circuit 1221 can connect to an input end of comparator CMP2. Current integration circuit 1221 may integrate the single-pulse current. When current integration signal VA is increased to be a value greater than or equal to that of compensation signal VC, the state of charge control signal CHG may change, such that states of the control signals of logic circuit 123 are reversed. In this case, time period T1 can end, and time period T2 begin. Transistor Q2 may be turned on due to control signal Vctr2 of logic circuit 123, such that the output of current integration circuit 1221 in current feedback circuit 122 is pulled down to ground. Capacitor C2 can be discharged to ground, such that current integration signal VA is reset. Therefore, the amount of accumulated charge of input current Iin during time period T1 (a time period/duration from time instant t1 to time instant t2) may be expressed as below in formula (1):

$$\int_{t1}^{t2} g_m I\text{in} R_{cs} dt = C_2 VC \tag{1}$$

That is, as shown below in formula (2):

$$\int_{t1}^{t2} I\text{in} dt = \frac{C_2 VC}{g_m R_{cs}} \tag{2}$$

Here, gm represents a gain of current integration circuit 1221, Rcs represents a sampling resistor, and VC represents a compensation signal. The amount of accumulated charge of input current Iin during time period T1 may be kept constant.

Figure 7:
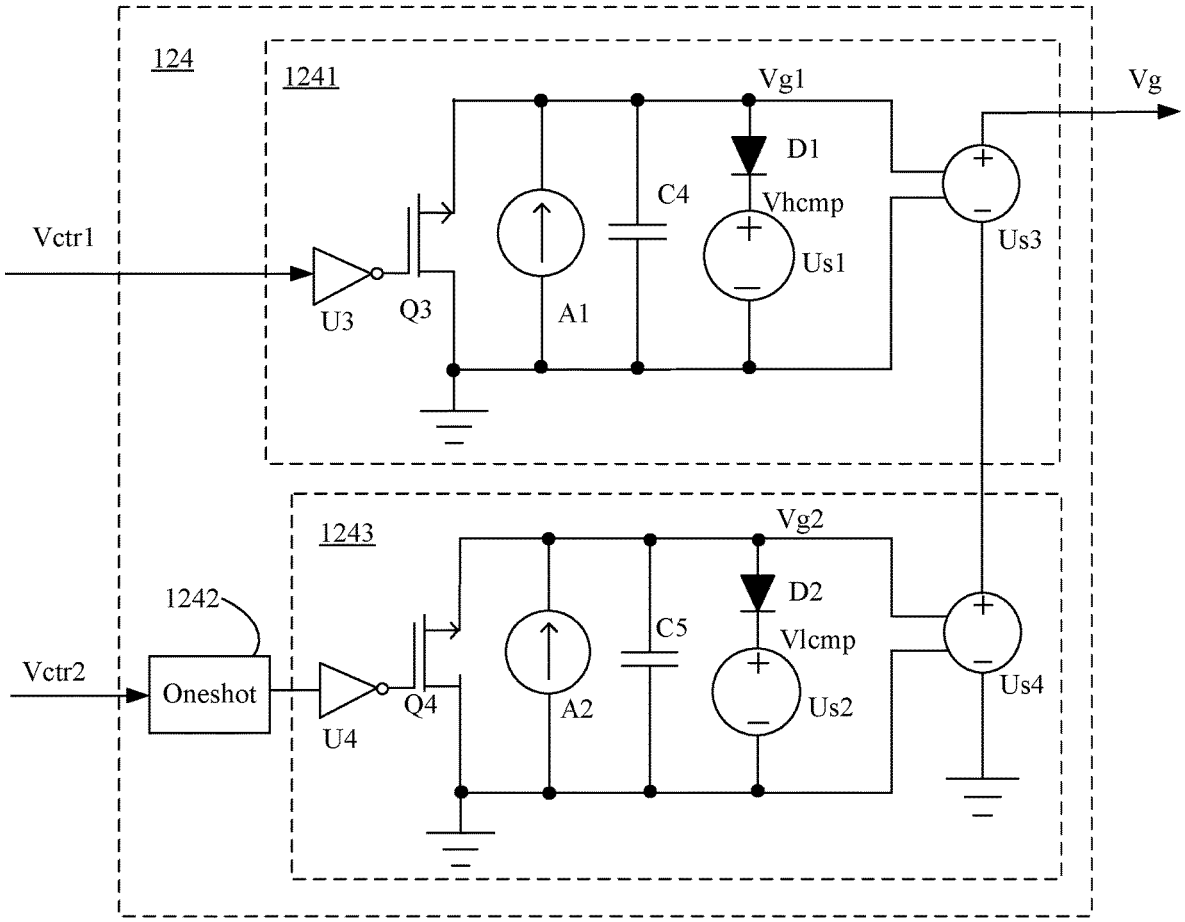
FIG. 7 is a schematic block diagram of an example driver of the example control circuit shown in FIG. 4, in accordance with embodiments of the present invention.

Referring now to FIG. 7, shown is a schematic block diagram of an example driver of the example control circuit shown in FIG. 4, in accordance with embodiments of the present invention. In this particular example, driver 124 can include single-pulse circuit 1241, timer 1242, and current limiting circuit 1243. Single-pulse circuit 1241 can include inverter U3, transistor Q3, current source A1, voltage sources Us1 and Us3, capacitor C4, and diode D1. An input of inverter U3 can receive control signal Vctr1, and an output of inverter U3 can connect to a control terminal of transistor Q3. Current source A1 and capacitor C4 can connect in parallel between two power terminals of transistor Q3. Intermediate signal Vg1 may be generated between two terminals of capacitor C4. Further, diode D1 and voltage source Us1 may form a high clamping circuit connected between the two terminals of capacitor C4. When intermediate signal Vg1 is higher than high clamping signal Vhcmp provided by voltage source Us1, intermediate signal Vg1 can be clamped at a value equal to Vhcmp+Vdiode, where Vdiode represents a forward voltage drop of diode D1. Voltage source Us3 can be a voltage-controlled voltage source. One control terminal of voltage source Us3 can receive intermediate signal Vg1, and the other control terminal of voltage source Us3 may be grounded. Drive signal V1 can be provided between two output terminals of voltage source Us3.

For example, timer 1242 may be a one-shot circuit. An input of timer 1242 can receive control signal Vctr2, and an output of timer 1242 may provide a timing signal. For example, the one-shot circuit may set a pulse width of the timing signal to be equal to Δt (e.g., about 3 ms), such that a predetermined delay time period can be obtained. Current limiting circuit 1243 can include inverter U4, transistor Q4, current source A2, voltage sources Us2 and Us4, capacitor C5, and diode D2. An input of inverter U4 can receive the timing signal, and an output of inverter U4 can connect to a control terminal of transistor Q4. Current source A2 and capacitor C5 can connect in parallel between two power terminals of transistor Q4. Intermediate signal Vg2 may be generated between two terminals of capacitor C5. Further, diode D2 and voltage source Us2 may form a low clamping circuit connected between the two terminals of capacitor C5.

When intermediate signal Vg2 is higher than low clamping signal Vlcmp provided by voltage source Us2, intermediate signal Vg2 can be clamped at a value equal to Vlcmp+Vdiode, where Vdiode represents a forward voltage drop of diode D2. Voltage source Us4 can be a voltage-controlled voltage source. One control terminal of voltage source Us4 may receive intermediate signal Vg2, and the other control terminal of voltage source Us4 may be grounded. Drive signal V2 having a preset pulse width Δt can be provided between two output terminals of voltage source Us4. Transistor Q1 can generate a low clamp current Ilc under control of control signal V2, such that input current Iin may remain at low clamp current Ilc for a fixed duration Δt. Therefore, the amount of accumulated charge of input current Iin during time period T2 (a time period/duration from time instant t2 to a time instant t3) may be expressed as below in formula (3):

$$\int_{t2}^{t3} I\text{in}dt = I_{lc}\Delta t \tag{3}$$

Here, Δt=t3−t2. The amount of accumulated charge of input current Iin during time period T2 may remain constant. From the formulas (1)-(3), the amount Q of accumulated charge of input current Iin during the half power frequency period may be expressed as below in formula (4):

$$Q = \int Iin = \int_{t1}^{t2} Iindt \Big| \int_{t2}^{t3} Iin\ dt = \frac{C_2 VC}{g_m R_{cs}} \Big| I_{1c}\Delta t \tag{4}$$

A value of the amount Q of accumulated charge of input current Iin may be set by changing parameters in formula (4), such as by changing gain gm, sampling resistor Rcs or duration Δt of low clamp current Ilc. In one example, amount Q of accumulated charge of input current Iin during the half power frequency period can be controlled remain constant by setting various parameters.

In this example, control circuit 120 can control transistor Q1 to generate the single-pulse current and the constant current respectively in time periods T1 and T2 that are consecutive in each half power frequency period of direct current bus voltage Vbus. Control circuit 120 can control a value of input current Iin to be relatively large when a voltage difference between two power terminals of transistor Q1 is relatively small, and to control the value of input current Iin to be relatively small when the voltage difference between the two power terminals of transistor Q1 is relatively large. For example, in time period T1, clock signal CLK may be generated based on voltage sampling signal Vbs of alternating current input voltage Vac, and time period T1 may begin based on the clock signal, such that input current Iin flowing through transistor Q1 is concentrated in a time period during which a turn-on voltage drop of transistor Q1 is relatively small; that is, a time period during which a voltage difference between direct current bus voltage Vbus and load voltage Vled is relatively small.

In this case, the value of input current Iin is relatively large, and the amount of accumulated charge of input current Iin during time period T1 may remain constant. In time period T2, the voltage difference between the two power terminals of transistor Q1 is relatively large; that is, the difference between direct current bus voltage Vbus and load voltage Vled is relatively large. Charge control signal CHG may be generated based on current sampling signal Vs and current integration signal VA. Time period T1 may end and time period T2 begin based on charge control signal CHG. The value of input current Iin in time period T2 may be relatively small and remain constant. Time periods T2 in different half power frequency periods may have the same time length/duration, such that the amount of accumulated charge of input current Iin during time period T2 remains constant.

In this example, voltage source Us3 of single-pulse circuit 1241 and voltage source Us4 of current limiting circuit 1243 can connect in series between the control terminal of transistor Q1 and ground. In time period T1 of the half power frequency period, voltage source Us3 may provide drive signal V1 as drive signal Vg. In time period T2 of the half power frequency period, voltage source Us4 may provide drive signal V2 as drive signal Vg. In time period T1, transistor Q1 can operate in the switching mode, in order to generate the single-pulse current. In time period T2, transistor Q1 can operate in the linear mode/region, in order to generate the constant current.

Further, in time period T1, the current integration control may be performed based on the current sampling signal of the current flowing through transistor Q1, such that the amount of accumulated charge of input current Iin during time period T1 remains constant. In time period T2, the timing control can be performed such that the amount of accumulated charge of input current Iin during time period T2 remains constant. In this way, the amount of accumulated charge of input current Iin during the half power frequency period can be controlled to be constant, thereby achieving control for the current distribution range, and thus preventing light flickering that may be caused by the operation state of transistor Q1 not being adjusted in time due to signal interference and/or grid jitter.

Figure 8:
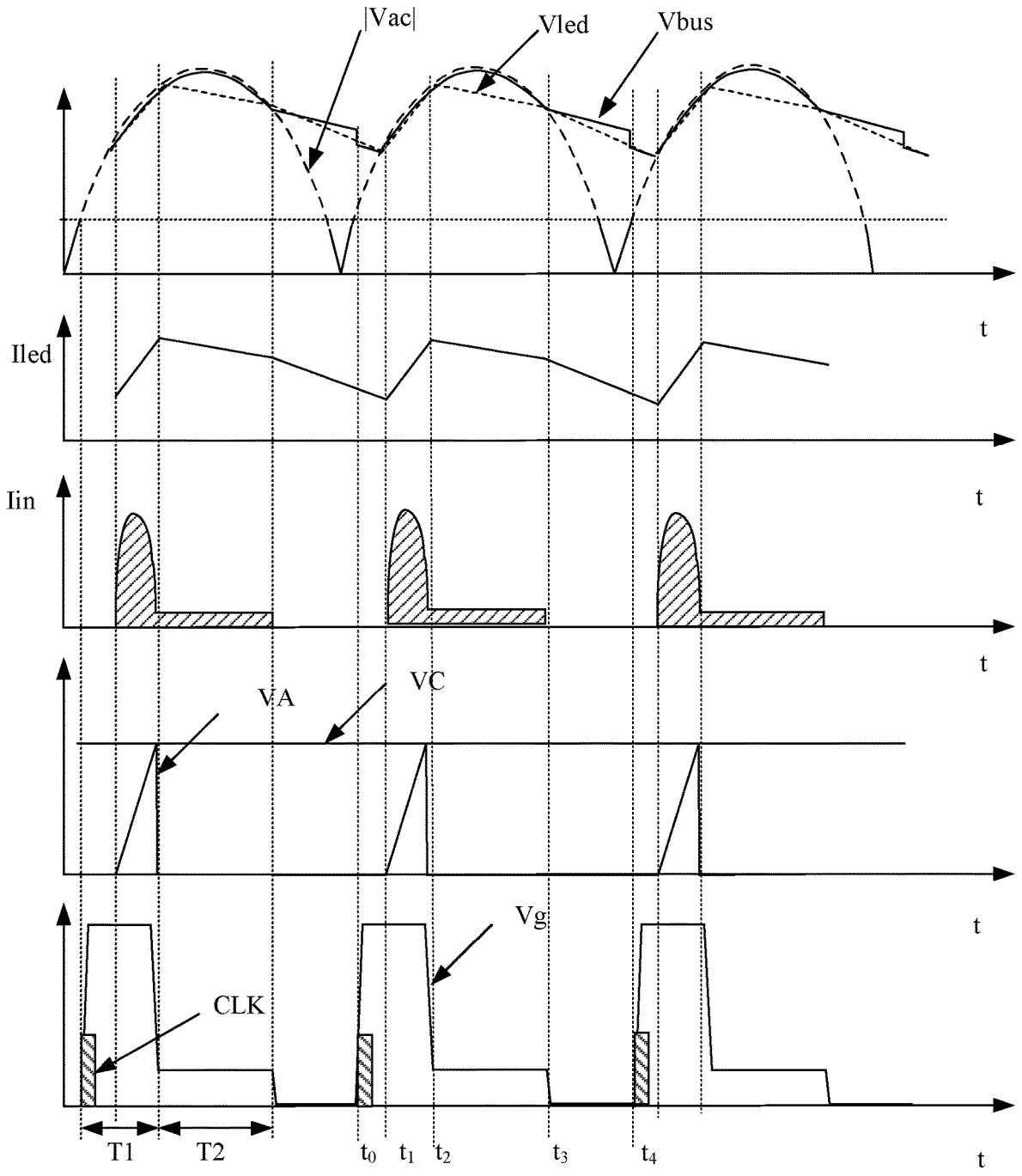
FIG. 8 is a waveform diagram of a first example operation mode of the first example LED drive circuit, in accordance with embodiments of the present invention.

Referring now to FIG. 8, shown is a waveform diagram of a first example operation mode of the first example LED drive circuit, in accordance with embodiments of the present invention. Here, |Vac| may represent an absolute value of an alternating current input voltage at input ends of the rectification bridge; that is, a theoretical output waveform of the rectification bridge. Vbus may represent a direct current bus voltage at an output of the rectification bridge. Vled may represent a terminal voltage between two terminals of the LED load. Iin may represent an input current (e.g., a current flowing through transistor Q1). In addition, CLK may represent a clock signal generated based on alternating current input voltage Vac, VA and VC may respectively represent a current integration signal and a compensation signal generated based on current sampling signal Vs of input current Iin, and Vg may represent a drive signal of transistor Q1.

With reference to FIGS. 4-7, the LED drive circuit in this example can include the main circuit and control circuit 120. The main circuit can include rectification bridge 110, the LED load, transistor Q1, capacitor C1, and sampling resistor Rcs. The LED load, transistor Q1, and sampling resistor Rcs can connect in series between the two outputs of rectification bridge 110. Control circuit 120 may generate drive signal Vg based on current sampling signal Vs of the current flowing through transistor Q1, in order to control the operation state of the transistor Q1. In time period T1 of the half power frequency period of direct current bus voltage Vbus, control circuit 120 may perform current integration control, such that transistor Q1 operates in the switching mode to generate the single-pulse current. Further, the amount of accumulated charge of the single-pulse current during time period T1 may be constant.

In time period T2 of the half power frequency period of the direct current bus voltage Vbus, control circuit 120 may perform timing control, such that transistor Q1 operates in the linear mode/region to generate the constant current. The amount of accumulated charge of the constant current during time period T2 may remain constant. Clock generator 121 in control circuit 120 may generate clock signal CLK based on voltage sampling signal Vbs of alternating current input voltage Vac. Current feedback circuit 122 in control circuit 120 may generate current integration signal VA and compensation signal VC based on current sampling signal Vs of the current flowing through transistor Q1, and can generate charge control signal CHG based on a comparison result between current integration signal VA and compensation signal VC.

When transistor Q1 is turned on, capacitor C1, the LED load and transistor Q1 may form a current path. Rectification bridge 110 can supply input current Iin to capacitor C1 and the LED load. One portion of input current Iin may flow to capacitor C1 to charge capacitor C1. The other portion of input current Iin may flow to the LED load such that terminal voltage Vled of the LED load is increased to drive the LED to emit light. After flowing through capacitor C1 and the LED load, input current Iin may flow to ground via transistor Q1. When transistor Q1 is turned off, the current path between rectification bridge 110, capacitor C1, and the LED load may be cut off, and input current Iin may decrease to zero. In this case, load current Iled can be supplied for the LED load by discharging capacitor C1, in order to drive the LED to continue to emit light, which may result in a decrease of the voltage across capacitor C1 (e.g., a decrease of load voltage Vled). Further, direct current bus voltage Vbus may have a waveform that substantially periodically varies with a sinusoidal half-wave signal under the influence of alternating current input voltage Vac of rectification bridge 110 and the operation states of transistor Q1 in the subsequent circuit.

As shown in FIG. 8, a control period of drive signal Vg can be equal to the half power frequency period of direct current bus voltage Vbus, but the control period of drive signal Vg may have a delay with respect to the start time instant of the half power frequency period of direct current bus voltage Vbus. That is, a time length of the control period of drive signal Vg may be equal to a time length from time instant t0 to time instant t4. At time instant t0, clock signal CLK may transition from an inactive state to an active state. Charge control signal CHG can be in an inactive state due to the reset of current integration signal VA. Drive signal Vg that is generated by control circuit 120 based on clock signal CLK and charge control signal CHG may be drive signal V1 having a relatively high clamp value. Transistor Q1 may be fully turned on and operate in the switching mode. In this example, when transistor Q1 is turned on, absolute value |Vac| of alternating current input voltage Vac of the rectification bridge may be lower than direct current bus voltage Vbus. Thus, at time instant t0, although transistor Q1 is turned on, rectification bridge 110 may not supply input current Iin to the LED load and capacitor C1. In this case, the value of input current Iin is zero, the load current Iled flowing through the LED load can be supplied by capacitor C1, and load voltage Vled and load current Iled may be decreased. For example, the pulse width of clock signal CLK may be about 500 μs.

Clock signal CLK may transition from the active state to the inactive state. At time instant t1, absolute value |Vac| of alternating current input voltage can be higher than load voltage Vled. Rectification bridge 110 may begin to supply input current Iin to capacitor C1 and the LED load. In the rising phase of direct current bus voltage Vbus, load voltage Vled and load current Iled may continuously increase. Input current Iin can be increased with the sinusoidal half-wave waveform of direct current bus voltage Vbus, and load voltage Vled may also be increased. Direct current bus voltage Vbus can substantially change along with the waveform of the sinusoidal half-wave signal. In this case, the difference between load voltage Vled and direct current bus voltage Vbus may be relatively small, and input current Iin can be the single-pulse current having a relatively large value, such that that the power loss of transistor Q1 may be relatively small. Correspondingly, current integration signal VA following load current Iled can be increased continuously, while compensation signal VC may substantially remain constant.

At time instant t2, since a value of current integration signal VA reaches a value equal to that of compensation signal VC, charge control signal CHG may transition from the inactive state to the active state. Clock signal CLK can be in the inactive state at this time. Drive signal Vg that is generated by control circuit 120 based on clock signal CLK and charge control signal CHG can be drive signal V2 having a relatively low clamp value. Transistor Q1 may generate the constant current and operate in the linear mode/region. Time instant t2 can be an end time instant of time period T1, and also the start time instant of time period T2. During time period T1 (e.g., a time period from time instant t1 to time instant t2), transistor Q1 may operate in the switching mode, input current Iin can be the single-pulse current, the waveform of load voltage Vled of the LED load may be substantially the same as the sinusoidal half-wave waveform of direct current bus voltage Vbus, and load current Iled may linearly increase along with the sinusoidal half-wave waveform of direct current bus voltage Vbus.

At time instant t3, after a predetermined delay from time instant t2 has elapsed, drive signal V2 may transition from an active state to an inactive state, such that transistor Q1 is turned off. Time instant t3 can be an end time instant of time period T2. During time period T2 (e.g., a time period from time instant t2 to time instant t3), transistor Q1 may operate in the linear mode/region to limit the current, input current Iin can be a stable low clamp current, and load voltage Vled and current Iled flowing through the LED load may begin to decrease. During the time period from time instant t3 to time instant t4, load current Iled and load voltage Vled can continuously be decreased, and input current Iin may decrease to zero. Direct current bus voltage Vbus may deviate from the standard half-wave signal waveform, and at time instant t4, a new control period may begin. Clock signal CLK may transition from the inactive state to the active state, such that transistor Q1 is turned on again, and the control period/cycle repeated.

In particular embodiments, a balance between keeping the current constant and reducing power loss can be achieved in the LED drive circuit. In time period T1, the input current may be a single-pulse current, and the difference between load voltage Vled and direct current bus voltage Vbus can be relatively small; that is, the voltage difference between the two power terminals of transistor Q1 is relatively small. In this way, heating generation and power loss due to the turn-on voltage drop of transistor Q1 can be substantially reduced. In time period T2, the input current can be a constant current, and the difference between load voltage Vled and direct current bus voltage Vbus may be relatively large; that is, the voltage difference between the two power terminals of transistor Q1 is relatively large. In this case, transistor Q1 may operate in the linear mode to limit the current, and to widen the distribution range of input current Iin, thereby reducing harmonic distortion and increasing the power factor.

In particular embodiments, the LED drive circuit may perform current integration control in time period T1, in order to keep the amount of accumulated charge of the input current during time period T1 constant. In addition, the LED drive circuit may perform timing control in time period T2, in order to keep the amount of accumulated charge of the input current during time period T2 constant. In this way, the average of the load current may remain constant, and constant current control can be achieved, in order to avoid flickering when the input voltage fluctuates due to grid jitter and/or signal interference. In certain embodiments, in the LED drive circuit, by the current closed-loop control, the linear adjustment rate of the circuit system can be effectively improved, and the distribution range of input current Iin can be widened, thereby reducing the harmonic distortion and increasing the power factor.

Figure 9:
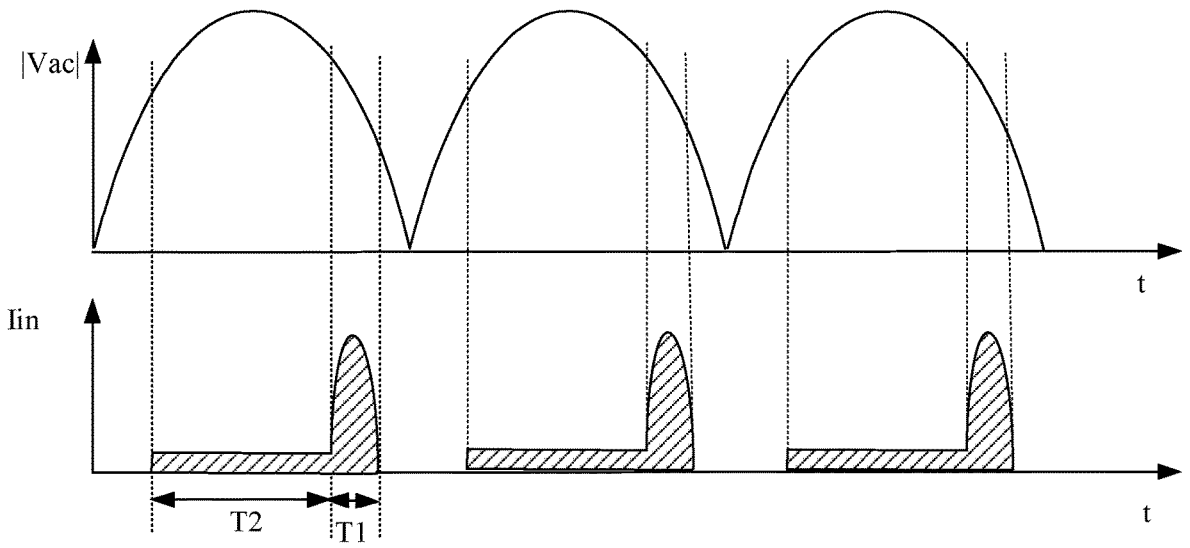
FIG. 9 is a waveform diagram of a second example operation mode of the first example LED drive circuit, in accordance with embodiments of the present invention.

Referring now to FIG. 9, shown is a waveform diagram of a second example operation mode of the first example LED drive circuit, in accordance with embodiments of the present invention. In this particular example, the single-pulse current may also be distributed in the falling phase of direct current bus voltage Vbus. The control manner for the example shown in FIG. 9 may be similar to that for the example of FIG. 8. In FIG. 9, time period T1 can be single-pulse current phase distributed in the falling phase of direct current bus voltage Vbus, and time period T2 may be a constant current phase similar to that of the example shown in FIG. 8, which may have substantially the same function for the LED drive circuit.

Figure 10:
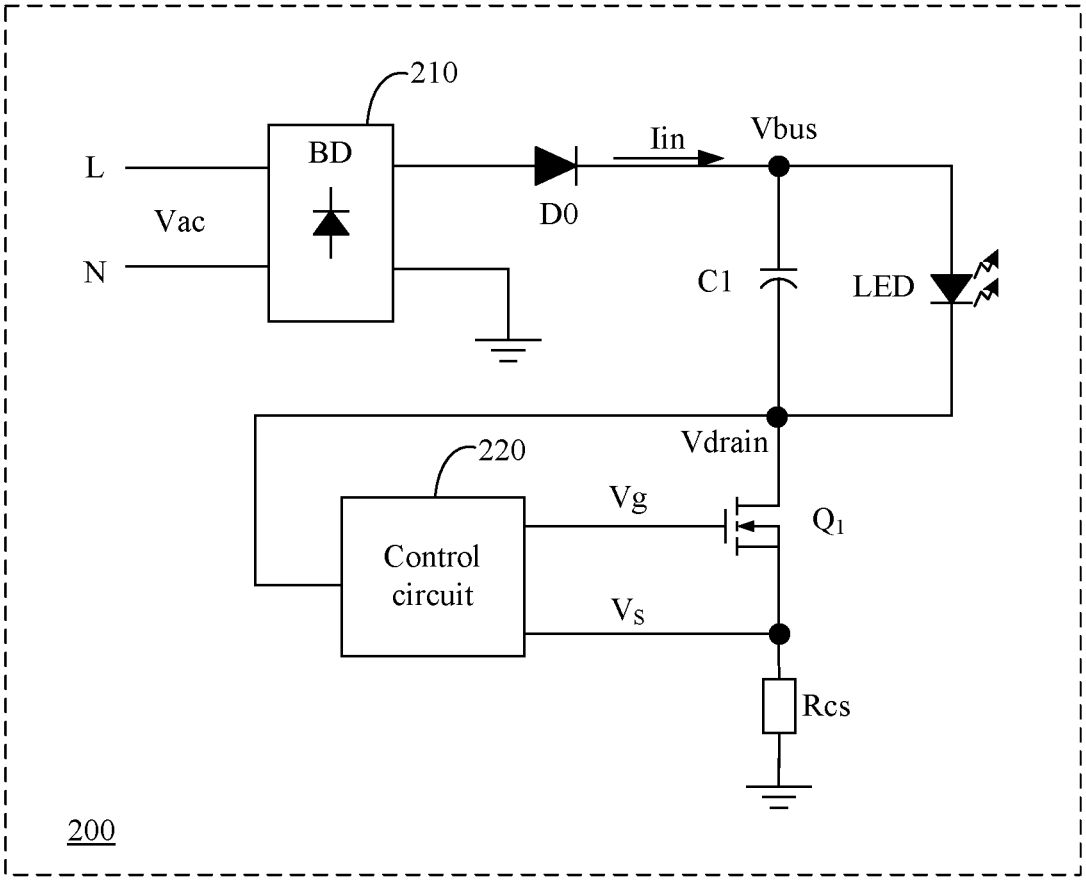
FIG. 10 is a schematic block diagram of a second example LED drive circuit, in accordance with embodiments of the present invention.

Referring now to FIG. 10, shown is a schematic block diagram of a second example LED drive circuit, in accordance with embodiments of the present invention. In this particular example, LED drive circuit 200 can include a main circuit and control circuit 220. The main circuit can include rectification bridge 210, an LED load, capacitor C1, transistor Q1, and sampling resistor Rcs. The LED load, transistor Q1, and sampling resistor Rcs can connect in series between two outputs of rectification bridge 210. The LED load and capacitor C1 can connect in parallel.

In this example, control circuit 220 in the LED drive circuit may generate drive signal Vg based on current sampling signal Vs, to control the operation state of transistor Q1, in order to control the amount of accumulated charge of input current Iin during a half power frequency period to be constant and to control the distribution range of input current Iin. This can improve the power factor and system efficiency of the LED drive circuit, and may prevent light flickering due to signal interference and/or grid jitter. Instead of control circuit 120 generating clock signal CLK based on voltage sampling signal Vbs indicating alternating current input voltage Vac, voltage sampling signal Vbs may be obtained by sampling drain voltage Vdrain of transistor Q1 in this particular example. Therefore, diode D0 can be connected in series between one output of rectification bridge 210 and an anode of the LED load, in order to prevent reverse flowing of the current. In other examples, voltage sampling signal Vbs may be obtained by sampling direct current bus voltage Vbus.

Figure 11:
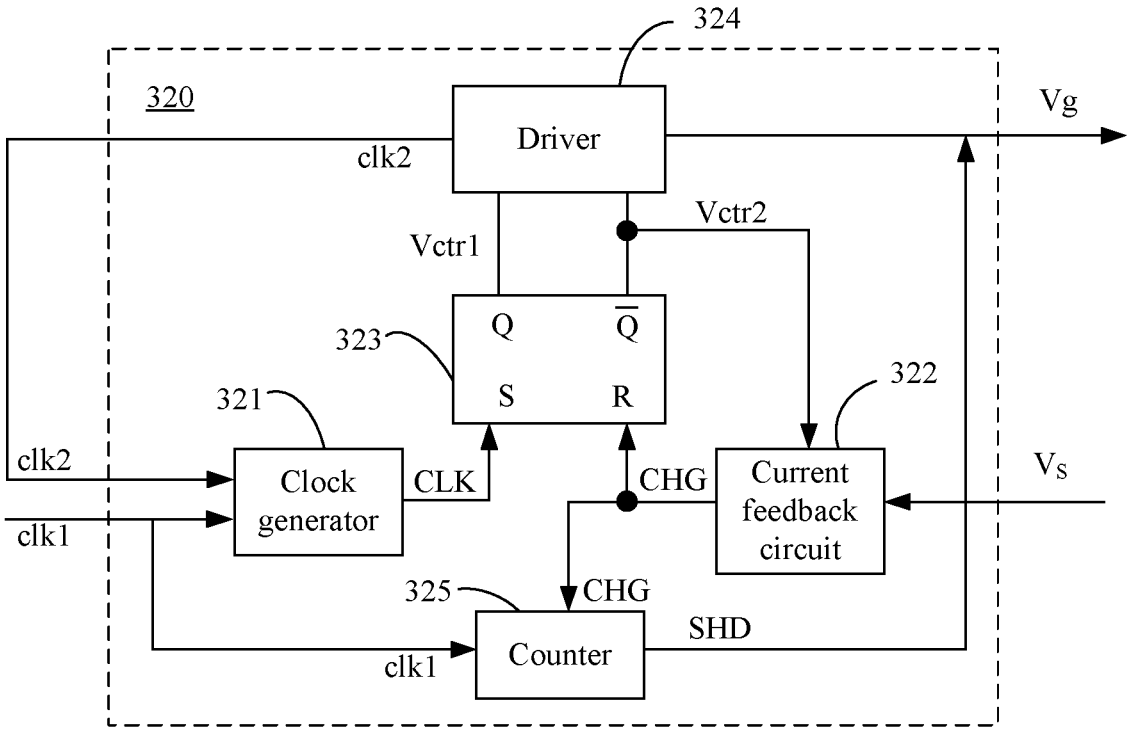
FIG. 11 is a schematic block diagram of an example control circuit of an example LED drive circuit, in accordance with embodiments of the present invention.

Referring now to FIG. 11, shown is a schematic block diagram of an example control circuit of an example LED drive circuit, in accordance with embodiments of the present invention. In this particular example, control circuit 320 can include clock generator 321, current feedback circuit 322, logic circuit 323, driver 324, and counter 325. Functions and operation principles of clock generator 321, current feedback circuit 322, logic circuit 323, and driver 324 may be substantially the same as those described above. In this particular example, counter 325 may be included in control circuit 320 to generate a turn-off signal SHD, in order to control a turn-off time instant of transistor Q1. Control circuit 320 can control transistor Q1 to generate a single-pulse current, a constant current, and a single-pulse current, respectively, in consecutive time periods T1, T2, and T3 in a half power frequency period. For example, in time periods T1 and T3, transistor Q1 may operate in the switching mode, while in time period T2, transistor Q1 may operate in the linear mode/region. For example, time period T1 can be in a rising phase of direct current bus voltage Vbus, time period T2 may be after time period T1, and time period T3 may be in a falling phase of direct current bus voltage Vbus and after time period T2. Counter 325 can control transistor Q1 to be turned off when time period T3 ends.

Control circuit 320 can control a value of input current Iin to be relatively large when a voltage difference between two power terminals of the transistor Q1 is relatively small, and to control the value of input current Iin to be relatively small when the voltage difference between the two power terminals of transistor Q1 is relatively large. For example, in a rising phase or a falling phase of the half power frequency period, the voltage difference between the two power terminals of transistor Q1 may be relatively small, and the value of input current Iin relatively large. In a peak time period of the half power frequency period, the voltage difference between the two power terminals of transistor Q1 can be relatively large, and the value of input current Iin relatively small. For example, clock generator 321 may select one of clock signal clk1 generated based on the sampling signal of alternating current input voltage Vac, and clock signal clk2 generated by driver 324, as clock signal CLK at a start time instant of the half power frequency period.

Current feedback circuit 322 may generate charge control signal CHG based on current sampling signal Vs and the current integration signal. Logic circuit 323 may generate, based on clock signal CLK and charge control signal CHG, complementary control signals Vctr1 and Vctr2. Driver 324 can connect to outputs of logic circuit 323, and driver 324 may generate drive signal Vg based on at least one of control signals Vctr1 and Vctr2. Further, current feedback circuit 322 can connect to an output of logic circuit 323, and current feedback circuit 322 may reset the current integration signal based on control signal Vctr2.

Counter 325 can receive charge control signal CHG generated by current feedback circuit 322 as a clock signal, and can count charge control signal CHG. The operation state of transistor Q1 can be controlled by an output of counter 325 and drive signal Vg generated by driver 324. When the count value of counter 325 reaches a predetermined value, counter 325 may activate turn-off signal SHD as drive signal Vg, in order to control transistor Q1 to be turned off. A clear control end of counter 325 can connect to an input of clock generator 321. When clock generator 321 selects clock signal clk1 as clock signal CLK, clock signal clk1 may be provided to counter 325 via the clear control end, in order to clear the count value.

Figure 12:
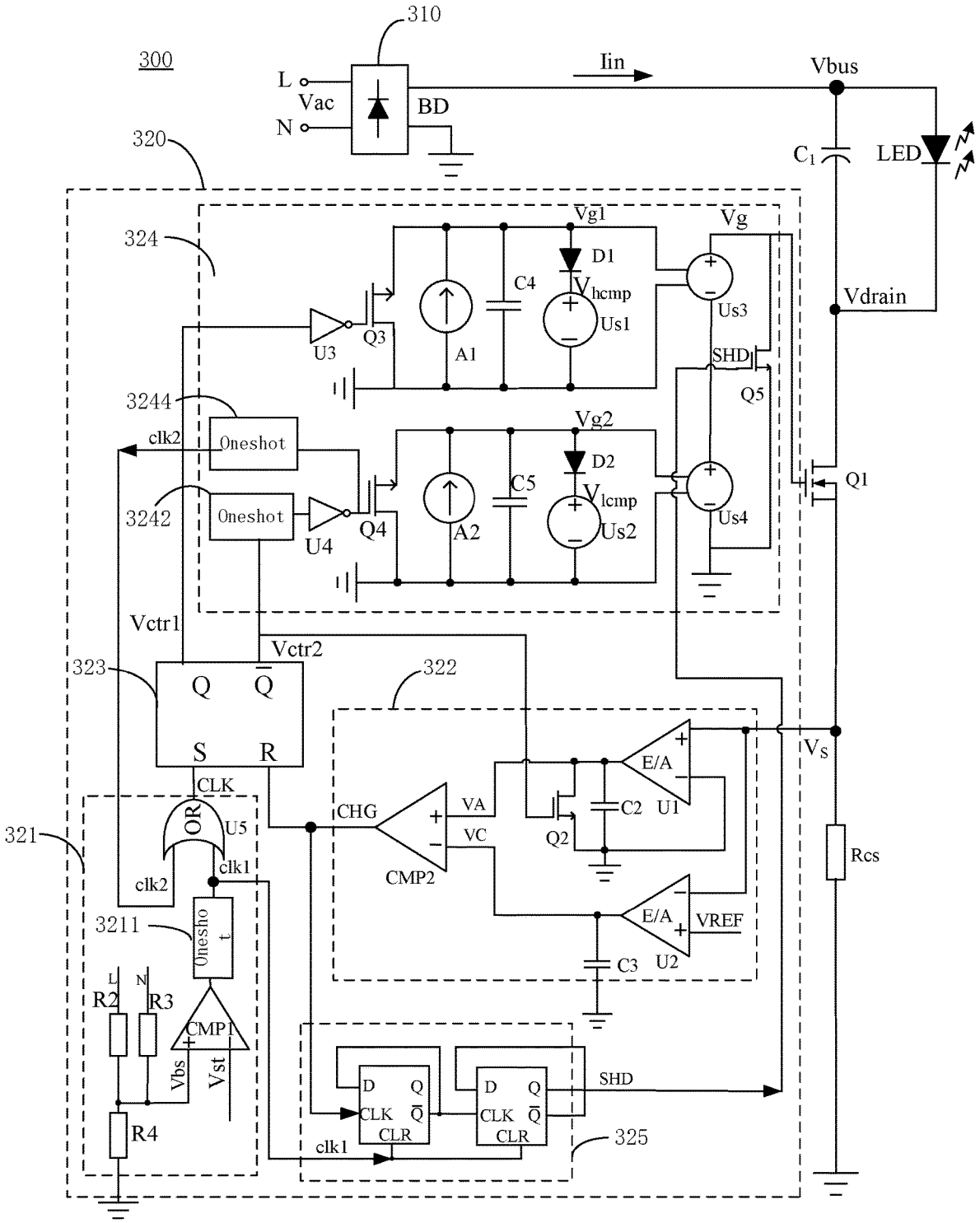
FIG. 12 is a schematic circuit diagram of a third example LED drive circuit, in accordance with embodiments of the present invention.

Referring now to FIG. 12, shown is a schematic circuit diagram of a third example LED drive circuit, in accordance with embodiments of the present invention. In this particular example, counter 325, clock signal generator 3244, and transistor Q5 can be included in control circuit 320. Driver 324 in control circuit 320 can include a single-pulse circuit, timer 3242, a current limiting circuit, and clock signal generator 3244. In driver 324, clock signal generator 3244 can be provided after timer 3242. For example, clock signal generator 3244 may be a one-shot circuit. An input of clock signal generator 3244 can connect to the output of inverter U4, and an output of clock signal generator 3244 may provide clock signal clk2. For example, the one-shot circuit may set a pulse width of the signal to be equal to Δt1, such as about 500 μs. Since clock signal generator 3244 may be arranged after timer 3242 and can connect to timer 3242 via inverter U4, clock signal generator 3244 may generate clock signal clk2 when time period T2 ends, to be provided to clock generator 321.

OR-gate U5 can be included in clock generator 321. One-shot circuit 3211 may provide clock signal clk1. Clock signal generator 3244 may provide clock signal clk2. Two input terminals of OR-gate U5 may respectively receive clock signals clk1 and clk2. OR-gate U5 can select one of clock signals clk1 and clk2 as clock signal CLK by performing a logic operation, and can provide the selected clock signal to the logic circuit 323 via an output terminal of OR-gate U5. For example, counter 325 can include a counter formed by two flip-flops. A counting input terminal CLK of counter 325 can receive charge control signal CHG as a clock signal, and counter 325 may count charge control signal CHG. An output terminal Q of the counter may provide turn-off signal SHD to driver 324. Transistor Q5 may be included in driver 324 and be connected between the control terminal of transistor Q1 and ground. When transistor Q5 is turned on by turn-off signal SHD at a control terminal thereof, the voltage at the control terminal of transistor Q1 can be pulled down to ground, and transistor Q1 can be turned off. Clear control terminal CLR of counter 325 can receive clock signal clk1 as a clear signal.

For example, the resistor divider network of clock generator 321 may acquire alternating current input voltage Vac. Clock generator 321 can generate clock signal clk1 as clock signal CLK via comparator CMP1 and one-shot circuit 3211. Clock signal CLK can be provided to logic circuit 323 at the start time instant of the half power frequency period, such that time period T1 begins. Logic circuit 323 may generate control signal Vctr1 based on clock signal CLK, and output control signal Vctr1 to driver 324. Counter 325 may clear the count value based on clock signal clk1 and start to count. Driver 324 may generate drive signal Vg based on control signal Vctr1 to turn on transistor Q1, in order to generate the single-pulse current. Current feedback circuit 322 can integrate sampling signal Vs of the input current. When current integration signal VA is increased to a value equal to a value of compensation signal VC, or a multiple of the value of compensation signal VC (VA=kVC), current feedback circuit 322 may activate charge control signal CHG provided to logic circuit 323, such that logic circuit 323 may generate control signal Vctr2.

Charge control signal CHG may be output to counting input terminal CLK of counter 325, such that "first" counting can begin. Driver 324 may generate drive signal Vg based on control signal Vctr2 generated by logic circuit 323, such that transistor Q1 operates in the linear mode to generate a constant current at a clamp value, and time period T2 may begin. Clock signal clk2 may be generated by sampling an end time instant of time period T2. Clock generator 321 may select clock signal clk2 as clock signal CLK, provide clock signal clk2 to logic circuit 323, and time period T3 may begin. The control of clock signal clk2 with respect to transistor Q1 may be substantially the same as the control of clock signal clk1 with respect to transistor Q1, such that transistor Q1 may again be controlled to generate a single-pulse current.

Current feedback circuit 322 can integrate sampling signal Vs of the input current and may again activate charge control signal CHG. Since counter 325 may again count charge control signal CHG, and the "second" counting begins, the count value of counter 325 may reach a predetermined value (e.g., equal to 2) and counter 325 may activate turn-off signal SHD to transistor Q5 according to the settings. Thus, the voltage of the control terminal of transistor Q1 may be pulled down to ground and transistor Q1 turned off. In this case, the current path can be cut off, the LED load may be supplied by capacitor C1, and the operation process in the half power frequency period completes until a next clock signal CLK.

Therefore, in this example, the amount of accumulated charge of input current Iin may be expressed as follows:

$$Q = \int i_{in}dt = \int_{t1}^{t2} i_{in}dt + \int_{t2}^{t3} i_{in}dt + \int_{t3}^{t4} i_{in}dt = \frac{2kC_1V_C}{g_mR_s} + i_{lcmp}\Delta t$$

Parameters in this formula are the same as those in the above example, where T3=t4−t3, and Δt=t3−t2. Accordingly, the amount of accumulated charge of input current Iin during the half power frequency period may be constant to prevent light flickering, which can be caused by the operation state of transistor Q1 not being adjusted in time due to signal interference and/or grid jitter.

Figure 13:
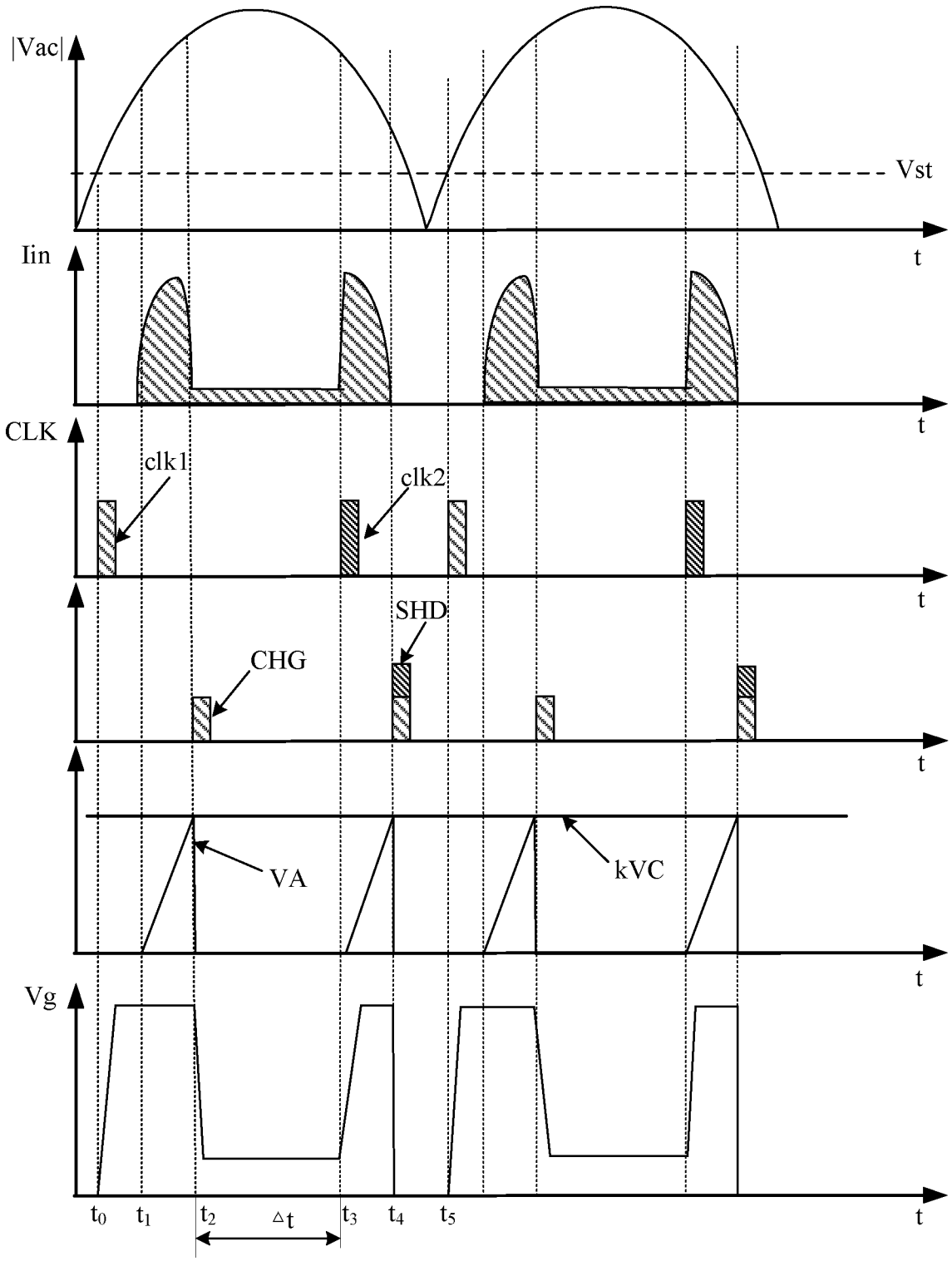
FIG. 13 is a waveform diagram of example operation of the third example LED drive circuit shown in FIG. 12, in accordance with embodiments of the present invention.

Referring now to FIG. 13, shown is a waveform diagram of example operation of the third example LED drive circuit shown in FIG. 12, in accordance with embodiments of the present invention. In this example, a control period of drive signal Vg can be equal to the half power frequency period of direct current bus voltage Vbus, but the control period of drive signal Vg may have a delay with respect to the start time instant of the half power frequency period of direct current bus voltage Vbus. That is, a time length of the control period of drive signal Vg can be equal to a time length from time instant t0 to time instant t5. At time instant t3, time period T2 ends; that is, the low clamp current time period ends. Clock signal generator 3244 may obtain the end time instant of the fixed low clamp time period by performing sampling and can activate clock signal clk2, such that clock signal CLK transitions from an inactive state to an active state. Charge control signal CHG may be in an inactive state due to the reset of current integration signal VA. Drive signal Vg that is generated by control circuit 320 based on clock signal CLK and charge control signal CHG may be drive signal V1 having a high clamp value. Time period T3 can begin, and transistor Q1 may gradually be turned on to operate in the switching mode.

In a time period from time instant t3 to time instant t4, current integration signal VA may be continuously increased, while compensation signal VC may substantially remain constant. At time instant t4, VA=kVC. Counter 325 may perform the second counting on charge control signal CHG. When VA=kVC, an edge of charge control signal CHG arrives, turn-off signal SHD may be activated, transistor Q5 can be turned on, drive signal Vg may be low, and transistor Q1 can be turned off. In this case, the load current of the LED load can be supplied by capacitor C1, and time period T3 ends. Transistor Q5 can be maintained in the turn-off state until time instant t5, and then the operation process in the half power frequency period can complete.

At time instant t5, a new control period may begin. Clock signal CLK may transition from the inactive state to the active state, such that transistor Q1 is turned on again. An edge of clock signal clk1 may arrive, the count value of counter 325 can be cleared, and the counting restarted. The control period/cycle can be repeated. In the LED drive circuit, in time periods T1 and T3, input current Iin may be a single-pulse current, and the difference between load voltage Vled and direct current bus voltage Vbus can be relatively small; that is, the voltage difference between the two power terminals of transistor Q1 may be relatively small. In this way, heating generation and loss due to the turn-on voltage drop of transistor Q1 can be greatly reduced. In time period T2, input current Iin may be constant low clamp current Ilc, and the difference between load voltage Vled and direct current bus voltage Vbus can be relatively large; that is, the voltage difference between the two power terminals of transistor Q1 is relatively large. Transistor Q1 can operate in the linear mode to limit the current to widen the distribution range of input current Iin and increase the power factor of the system.

Further, the LED drive circuit can perform current integration control in time periods T1 and T3, to keep the amount of accumulated charge of the single-pulse current during time periods T1 and T3 constant. In addition, the LED drive circuit can perform timing control in time period T2, to keep the amount of accumulated charge of the constant current during time period T2 constant. In this way, the average of the load current can remain constant, and constant current control can be achieved, such that that no flickering occurs when the input voltage fluctuates due to grid jitter and/or signal interference.

In particular embodiments, an example control method applied to control an LED driver can include, at a first step, a transistor (e.g., Q1) and an LED load connected in series with each other may receive a direct current bus voltage (e.g., Vbus) to generate an input current (e.g., Iin). At a second step, an operation state of the transistor may be controlled to adjust a distribution range of the input current by controlling the amount of accumulated charge of an input current during a half power frequency period. In addition, the transistor can be controlled to operate in a switching mode in a first time period (e.g., T1) to keep the input current as a single pulse current, and to operate in a linear mode in a second time period (e.g., T2) to keep the input current constant. Further, the input current can be controlled to be relatively large when a voltage difference between two power terminals of the transistor is relatively small, and controlled to be relatively small when the voltage difference between the two power terminals of the transistor is relatively large.

For example, the transistor may operate in the switching mode such that the amount of accumulated charge of the input current is constant during the first time period by integrating a current sampling signal (e.g., Vs) of the input current flowing through the transistor. Also, the transistor may operate in a linear mode such that the amount of accumulated charge of the input current is constant during the second time period by controlling corresponding second time periods of different half power frequency periods to have the same time length. In addition, the first time period may be in a rising phase of the direct current bus voltage, and the second time period follows the first time period. In particular embodiments, the first time period may be in a falling phase of the direct current bus voltage, and the second time period may be before the first time period. Further, the transistor can operate in the switching mode again, such that the amount of accumulated charge of the input current is constant during a third time period (e.g., T3) by integrating the current sampling signal of the input current flowing through the transistor. In addition, the first time period may be in the rising phase of the direct current bus voltage, the second time period can be after the first time period, and the third time period may be in the falling phase of the direct current bus voltage.

For example, a clock signal (e.g., CLK) can be generated based on a sampling signal of an alternating current input voltage, where the clock signal indicates a start time instant of the first time period. Alternatively, the clock signal may be generates based on a sampling signal of the direct current bus voltage or a drain voltage of the transistor. A charge control signal (e.g., CHG) may be generated based on the current sampling signal and a current integration signal of the current sampling signal, where the charge control signal indicates a start time instant of the second time period. First and second control signals (e.g., Vctr1 and Vctr2) that are complementary may be generated based on the clock signal and the charge control signal. Further, the drive signal (e.g., Vg) may be generated based on the first and second control signals, in order to control the transistor to operate in the switching mode in the first time period and control the transistor to operate in the linear mode in the second time period. In addition, a current integration signal (e.g., VA) may be generated by integrating the current sampling signal. A compensation signal (e.g., VC) may be generated based on an error between the current sampling signal and a reference voltage (e.g., VREF). In this way, the charge control signal may be generated by comparing the compensation signal against the current integration signal. In addition, a first drive signal as the drive signal may be generated based on the first control signal in the first time period, a timing signal may be generated based on the second control signal, and a second drive signal as the drive signal may be generated based on the timing signal.

For example, a second clock signal as the clock signal may be generated based on the timing signal in a third time period. Further, the second clock signal can indicate a start time instant of the third time period. In the third time period, the transistor may operate in the switching mode again, and the input current can be a single pulse current, such that the amount of accumulated charge of the input current is constant during the third time period by integrating the current sampling signal of the input current flowing through the transistor.

In particular embodiments, a linear-drive-controlled LED drive circuit can increase the power factor, reduce power consumption, improve efficiency, and prevent light flickering. In addition, the operation state of the transistor can be controlled in a time-sharing manner to control the magnitude and duration of the input current flowing through the LED load and capacitor C1, thereby increasing the current duration in the control period, reducing the current ripple, and increasing the power factor. By controlling the operation state of the transistor, the amount of accumulated charge of the input current during the half power frequency period can remain constant, thereby preventing light flickering due to grid jitter.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A light-emitting diode (LED) drive circuit, comprising:

a) a capacitor and an LED load coupled in parallel to receive an input direct current bus voltage;

b) a transistor coupled in series with said LED load; and c) a control circuit configured to generate a drive signal to control an operation state of the transistor to control an input current to be a first current during a first time period of a half power frequency period, and to be a second current during a second time period of the half power frequency period, wherein the first current is greater than the second current.

2. The LED drive circuit of claim 1, wherein the first current is a single-pulse current in the first time period, and the second current is a constant current in the second time period.

3. The LED drive circuit of claim 1, wherein the transistor operates in a switching mode during the first time period, and the transistor operates in a linear mode during the second time period.

4. The LED drive circuit of claim 1, wherein an amount of accumulated charge of the input current during the half power frequency period is kept constant.

5. The LED drive circuit of claim 4, wherein the amount of accumulated charge of the first current is constant during the first time period, and the amount of accumulated charge of the second current is constant during the second time period.

6. The LED drive circuit of claim 1, wherein a voltage difference between two power terminals of the transistor during the first period is less than a voltage difference between the two power terminals of the transistor during the second period.

7. The LED drive circuit of claim 1, wherein the first time period is in a rising phase of the direct current bus voltage, and the second time period occurs after the first time period.

8. The LED drive circuit of claim 1, wherein the first time period in a falling phase of the direct current bus voltage, and the second time period occurs before the first time period.

9. The LED drive circuit of claim 1, wherein the control circuit is configured to control the input current to be the first current during a third time period of the half power frequency.

10. The LED drive circuit of claim 9, wherein the first time period is in a rising phase of the direct current bus voltage, the second time period is after the first time period, and the third time period is in a falling phase of the direct current bus voltage.

11. The LED drive circuit of claim 1, wherein a length of the first time period is adjusted based on a current sampling signal representing the input current flowing through the transistor, and a length of the second time period has a preset value.

12. The LED drive circuit of claim 11, wherein a length of a third time period of the half power frequency period is consistent with the length of the first time period.

13. The LED drive circuit of claim 1, wherein the control circuit comprises:

a) a clock generator configured to generate, based on a sampling signal representing a voltage difference between the two power terminals of the transistor, a first clock signal indicating a start time instant of a first time period; and b) a current feedback circuit configured to generate, based on a current sampling signal of the input current flowing through the transistor, a charge control signal indicating a start time instant of a second time period.

14. The LED drive circuit of claim 13, wherein the control circuit further comprises a driver configured to generate the drive signal based on the clock signal and the charge control signal to control the operation state of the transistor.

15. The LED drive circuit of claim 13, wherein the current feedback circuit comprises:

a) a current integration circuit configured to integrate the current sampling signal to generate a current integration signal;

b) a closed-loop feedback circuit configured to generate a compensation signal based on an error between the current sampling signal and a reference voltage; and c) a comparator configured to compare the compensation signal against the current integration signal to generate the charge control signal.

16. The LED drive circuit of claim 14, wherein the driver comprises:

a) a single-pulse circuit configured to generate a first drive signal based on the first clock signal during the first time period;

b) a timer configured to generate a timing signal with a preset pulse width based on charge control signal; and c) a current limiting circuit coupled to the timer, and being configured to generate a second drive signal based on the timing signal during the second time period.

17. The LED drive circuit of claim 16, wherein the current limiting circuit comprises a voltage-controlled voltage source configured to generate the second drive signal, and the driver generates the first drive signal during the first time period as the drive signal to control the input current to be a single pulse current, and the driver generates the second drive signal during the second time period as the drive signal to control the input current.

18. The LED drive circuit of claim 11, wherein the control circuit comprises a one-shot circuit, configured to generate a second clock signal indicating a start time instant of a third time period of the half power frequency period when the second time period ends.

19. The LED drive circuit of claim 18, wherein the control circuit comprises a counter, configured to count the charge control signal, and when the counter counts the charge control signal twice, the counter generates a turn-off signal to control the transistor to turn off.

* * * * *